United States Patent [19]

Kronseder et al.

[11] 4,147,011

[45] Apr. 3, 1979

[54] BOTTLE TREATING APPARATUS

[75] Inventors: Hermann Kronseder, Regensburger Str., 8404 Wörth, Donau, Fed. Rep. of Germany; Karl Dullinger, Neutraubling, Fed. Rep. of Germany

[73] Assignee: Hermann Kronseder, Wörth, Fed. Rep. of Germany

[21] Appl. No.: 599,309

[22] Filed: Jul. 25, 1975

[30] Foreign Application Priority Data

Jul. 30, 1974 [DE] Fed. Rep. of Germany ..... 2436591
Oct. 29, 1974 [DE] Fed. Rep. of Germany ..... 2451310

[51] Int. Cl.[2] ..... B65C 3/14
[52] U.S. Cl. ..... 53/137
[58] Field of Search ..... 53/137, 279, 287; 198/22 B, 104; 156/536

[56] References Cited

U.S. PATENT DOCUMENTS

| | | | |
|---|---|---|---|
| 1,133,602 | 3/1915 | Woodland | 198/22 B X |
| 1,583,627 | 5/1926 | Taliaferro | 53/279 |
| 1,649,267 | 11/1927 | Tevander | 198/22 B |
| 2,029,823 | 2/1936 | Huntley et al. | 53/279 |
| 2,109,505 | 3/1938 | Rue et al. | 53/137 X |
| 2,239,120 | 4/1941 | Stewart et al. | 53/279 |
| 2,540,120 | 2/1951 | Jacobs et al. | 53/279 X |
| 2,829,757 | 4/1958 | Breeback | 198/104 X |
| 3,314,519 | 4/1967 | Kelly | 198/104 X |
| 3,519,108 | 7/1970 | Webb et al. | 198/104 X |
| 3,613,858 | 10/1971 | Cox | 214/16 B |
| 3,841,946 | 10/1974 | Carter | 198/104 X |

*Primary Examiner*—John Sipos
*Attorney, Agent, or Firm*—Joseph P. House, Jr.

[57] ABSTRACT

A bottle filling and closing machine and a bottle labeling machine are mounted on opposite sides of a bottle conveyor line close enough together so that both machines can be operated by a single operator. The filling and closing machine, the labeling machine, and the conveyor means extending therebetween are normally driven in synchronism by a common motor. A clutch is included in the drive means for the labeling machine to enable it to be disconnected from the filling and closing machine, and an auxiliary drive motor is coupled to the labeling machine to enable it to be driven independently of the filling and closing machine. The conveyor means extending between the two machines can comprise conveyor star wheels or conveyor worms.

2 Claims, 6 Drawing Figures

BOTTLE TREATING APPARATUS

BACKGROUND OF THE INVENTION

This invention relates to bottle treating apparatus including a combined bottle filling and closing machine, a bottle labeling machine, bottle conveyor means extending therebetween, and means for synchronously driving the machines and conveyor means to fill, close, and label bottles.

With the bottle treating apparatus presently used, the different treating machines are located a certain distance from each other and they are connected by single or multi-slat bottle conveyors, sometimes combined with accumulator tables. The reason for this arrangement is to prevent a short stoppage of one machine from effecting the other machines of the unit. The accumulator tables can take a certain number of bottles delivered from the filling and closing machine and can deliver a certain number of needed bottles to the labeling machine. It has been thought to be essential to allow the bottles to accumulate between the combined filling and closing machine and the labeling machine. The accumulator equipment, however, causes further disturbances, as in case of transferring and braking of the bottles, coming out of the filler in one line and being separated into several lines, or when bottles are accumulated onto one line in the infeed of the labeling machine, the bottles often break or jam. In addition, the accumulator equipment requires a lot of room and causes most of the noise in the bottling room because of the continuous clashing together of the bottles. Also, one operator is necessary for each machine, because the machines are installed too far away from each other to be served by a single operator.

There is already known a bottle treating unit, including several machines located on the same side of a continuous conveyor. With this machine, disclosed in U.S. Pat. No. 3,613,858 transferring of the bottles between the machines is done by conveyor worms. A synchronous drive of all machines is effected by a regulating device, which senses the speed of each machine and effects their drive. The constructive efforts for achieving a synchronous drive are excessive. To permit the machines to be easily accessible, a certain minimum distance therebetween has to be observed, and this leads to a high area requirement. The conveyor worms are long and require many intermediate bearings.

Another bottle treating unit is known, in which the two machines are also mounted on the same side of the conveyor which transfers the bottles (German Pat. No. 913 747). Because of the disadvantageous arrangement of the machines, one operator is necessary for each machine. The area requirement is high and transferring the driving power between the machines requires excessive effort. Since the bottles cannot be transported by the slat conveyor with equal spacing from each other, a separating device for the bottles is necessary just before the labeling machine, so that trouble-free transport of the bottles between the two machines is not provided.

SUMMARY OF THE INVENTION

The principal object of this is to provide a compact bottle treating unit, including a filler and closer machine and a labeling machine, and means for effecting a trouble-free transfer of the bottles between the two machines, which are arranged so that only one operator is required for both machines.

In accordance with this invention the combined filling and closing machine and the labeling machine are arranged opposite each other on different sides of the conveyor line defined by the bottle infeed conveyor and the bottle outfeed conveyor. Owing to the fact that the two machines are mounted very close together on two different sides of the conveyor line, an extremely compact construction is provided and an easy accessibility for attending and operating purposes is achieved. Additionally, it is possible for both machines to be attended and operated by only one person. The invention is aided by the fact that the controlling devices of the filling machines are usually positioned at the front side in the area of the bottle infeed and bottle outfeed, whereas the operator of a labeling machine is mainly working on the reverse side, positioned opposite to the bottle infeed, when feeding in the labels and so on. Both machines can easily be supervised and reached from one place because of the arrangement of this invention. Trouble within the conveying area is avoided as a result of the close arrangement of the machines and the transfer of the bottles by a driving element provided with pockets. It is therefore not necessary to supervise this area and the operator can concentrate on the bottle infeed of the filler and on feeding in the labels and so on. A further advantage of the close arrangement is that transferring of the driving moment between the two machines can be provided with simple means. In this connection it should be mentioned that a modern high-speed labeling machine can easily match a filler with the same capacity concerning reliability in service. Moreover, the trouble arising out of accumulator tables and conveyors are avoided with a unit according to this invention, so that the unit of this invention can work with high effectiveness and costs of investment and operating staff can be reduced substantially.

A bottle treating unit of this invention can easily be accommodated to room requirements. The transport of the bottles to or away from the unit can be effected by a straight moving conveyor or by two conveyors moving parallel to each other. It is especially advantageous, when, according to a further aspect of the invention, the bottle infeed conveyor and the bottle outfeed conveyor are moving perpendicular to each other and the two machines are partly fitted opposite to each other on different sides of the transport line defined by the conveyors. This provides an especially narrow kind of construction, and all bottle treating devices, refill stations and so on are easily reached, since the operating sides of the machines are directly adjacent to each other.

There are several ways of driving the bottle treating unit. According to a preferred aspect of the invention, however, the driving motor of the filling and closing machine has sufficient drive capacity for both machines and the labeling machine is connected with the drive motor by means of a gear train. By this means, an especially simple construction is provided. A usual filler having an accordingly strong driving motor can be used, from which power is taken off at a suitable location for the labeling machine.

It is especially advantageous, if according to a further aspect of the invention, a positive clutch coupling is fitted to the gear train for connecting and disconnecting the labeling machine from the filling and closing machine. In case of a change over or repair, the single machines can be separated from each other. It is also possible to put a positive coupling into the gear train for driving the filler, so that only one of the two machines can be driven by the motor. It is also advantageous, if according to a further aspect of the invention, the labeling machine can be driven independently from the filling and closing machine by means of an auxiliary motor via a free wheeling clutch or a coupling. With an arrangement of this kind, both machines can work at the same time independent from each other. The auxiliary motor only needs very little power in comparison with the filler motor. Free wheeling enables the two machines to be connected while running. Any driving or connecting element that enables a connection of the two machines according to the pitch can be used. A claw coupling can be used e.g. with which the claws are arranged in such a distance from each other as to correspond to the pitch of the bottles.

The drive gear train to the labeling machine can be formed in different ways. According to a further aspect of the invention in the gear train, one gear is mounted on the shaft of a conveyor star wheel to transfer the driving moment to the labeling machine. This gear also drives the conveyor star wheel and provides a simple construction.

It is however, especially advantageous, if according to another aspect of the invention, a fast-running shaft for transferring the driving moment to the labeling machine is fitted in the gear train. In this way, a relatively thin shaft can transfer the drive to the labeling machine, where speed is reduced again by means of a worm gear of the like. Using several single gears driven by the fast-running shaft for the drive of different conveyor stars prevents play between the gears from effecting the bottles.

The conveyor means for the bottles can be provided by one or more conveyor star wheels and/or feed worms, which enable a trouble-free bottle transport according to the pitch between both machines.

If the filler and the labeling machine have bottle tables with different pitches for the bottles, according to a further aspect of the invention the bottle infeed star of the labeling machine, the conveyor star wheel transferring the bottles to this star wheel and, if required, further intermediate star wheels have pitches for the bottles which are slightly different from each other, in such a way that the differing pitches of both bottle tables are compensated for gradually. For bridging over the different pitches, no further equipment is necessary, which provides especially advantageous in case of a change of the unit because of different bottle shape.

Another possibility is that the feed worm can have a continous increasing pitch, so that the different pitches of the two bottle tables are compensated for.

In the case that play that causes bottle breakage cannot be avoided between the worm and conveyor means arranged before and afterwards, it is recommended, according to a further aspect of the invention, that the conveyor means use two worms, which are arranged on two different sides of the conveyor line, the end of the first worm being arranged according to the pitch opposite the beginning of the second worm, that the first worm be connected according to the drive with the filling and closing machine and the second worm be connected with the labeling machine, and that the cross-section of the worm threads are bigger in the areas opposite each other than is necessary for receiving the bottle. This arrangement can also be used with a bottle treating unit which is different from the invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
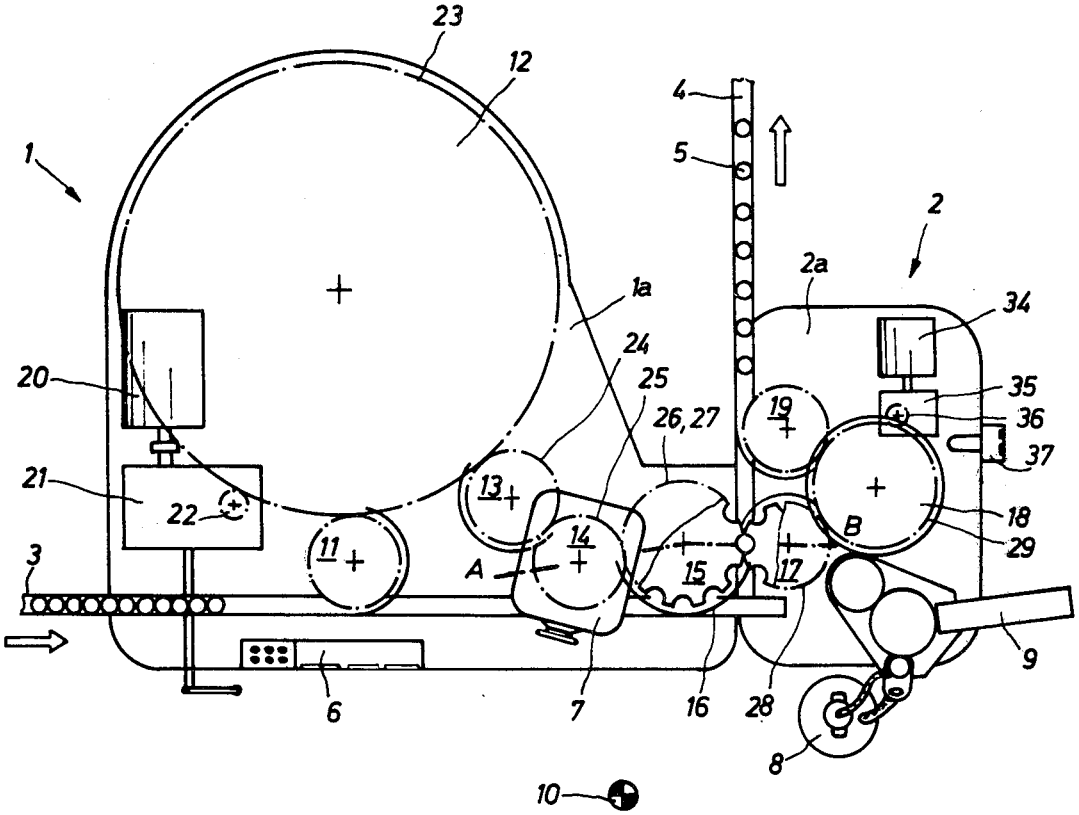
FIG. 1 is a schematic top view of a bottle treating unit of this invention.
Figure 2:
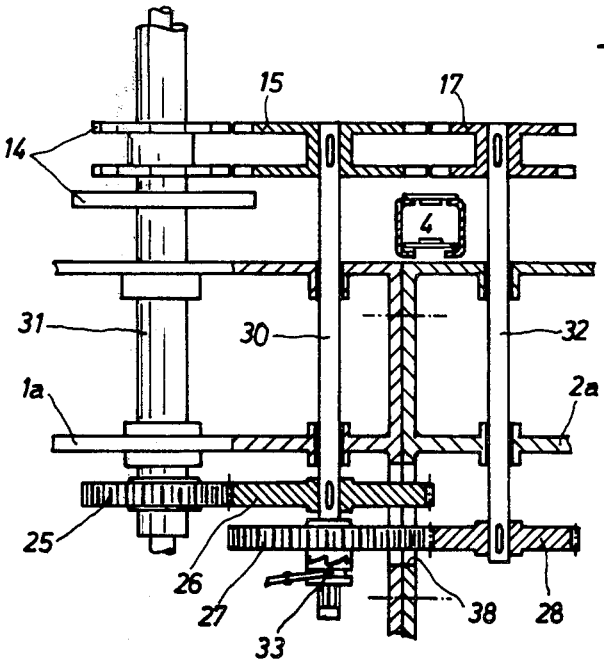
FIG. 2 is a cross-sectional view taken on the line AB of FIG. 1.

The bottle treating unit according to FIGS. 1 and 2 consists of a bottle filling and closing machine 1, a labeling machine 2, a bottle infeed conveyor 3 and a bottle outfeed conveyor 4. Construction of the machines is mostly known and will therefore be described only so far as it is necessary for understanding of the invention. As shown in FIG. 1, the infeed and outfeed conveyors 3 and 4 are arranged at right angles to each other. Conveyors 3 and 4 consist of conventional slat band chains and lateral rails and are driven synchronously with the machines 1 and 2 by conventional means not shown. Infeed and outfeed conveyors 3 and 4 form the main portion of the conveyor line for bottles 5. The filling and closing machine is mounted on the left side of the conveyor line and labeling machine 2 is mounted on the right side of the conveyor line in such a way, that the housings 1*a* and 2*a* of the two machines touch each other and that the machines are opposite each other in the area of the outfeed conveyor 4. The operating panel 6 of the filling and closing machine 1, the hopper 7 for the caps of the closing machine 7, the glue container 8 and the label magazine 9 of the labeling machine 2 are positioned on one side of the conveyor line and can easily be reached from the operator's position 10 in FIGS. 1 and 4.

The bottles 5, arriving on the infeed conveyor 3, are spaced apart a certain distance by an infeed worm (not shown) or the like. Bottles 5 are received by the infeed star 11 and are carried to the rotating bottle table 12. The filled bottles are transferred by star 13 to the closing apparatus 7 which is equipped with a bottle table 14. Conveyor star wheel 15 having a stationary guide 16, takes the bottles 5 from the closing apparatus and conveys them to the infeed star wheel 17 of the labeling machine 2. From there the bottle table 18 takes the bottles through the labeling station and the outfeed star 19, which finally conveys the bottles onto the outfeed conveyor 4. To simplify the drawings, in most cases only the pitch circle of the bottle tables and conveyor star wheels are drawn. The bottles are transported positively and according to the pitch from the filler infeed to the labeling machine outfeed without touching each other. Conveyor stars, 11, 13, 15 and 17 all include spaced pockets for receiving the bottles 5.

In case the bottle tables 12 and 18 of the filler and labeling machine have the same pitches for the bottles, all conveyor star wheels also have this pitch. If, however, the pitch of the bottle table 18 of the labeling machine 2 is larger than the pitch of bottle table 12, as it is normally the case, the pitches of the conveyor star wheels, i.e. the distance between their pockets in the bottle transport direction, is progressively bigger, so that the bottles will be put into the desired spacing before reaching the bottle table 18.

The whole unit is driven by a main motor 20 in the housing 1*a* of the filling and closing machine. The main motor 20 drives the toothed wheel rim 23, which is connected with bottle table 12 and coincides with the pitch circle of the bottle table, by means of a pinion 22 and a drive transmission 21 adjustable by a hand lever. Power is transferred from the toothed wheel rim 23 in the same direction as the bottles are transferred by gears 24 to 28 which are connected with the conveyor star wheels 13–17 to a toothed wheel rim 29, which is connected with the bottle table 18 of the labeling machine. The pitch circle of gears 24 to 28 is equal to the pitch circle of the connected star wheels 13–17. The outfeed star 19 and the labeling device are driven from the toothed wheel rim 29. In this manner an absolute synchronous drive of the two machines and of all conveyor star wheels is achieved.

As is visible in FIG. 2, on the shaft 30 of the conveyor star wheel 15, which is fitted in the housing 1*a* of the filling and closing machine 1, two gears 26 and 27 of the same diameter are mounted. Gear 26 is firmly connected to the shaft 30 and is driven by gear 25, which is attached on the hollow driving shaft 31 of the closing apparatus. The other gear 27 is arranged freely movable and is in mesh with gear 28, which is attached on the shaft 32 of the infeed star 17. By means of a changeable claw clutch coupling 33, gear 27 can be brought into driving connection with the shaft 30. The claw clutch coupling 33 therewith enables removing the drive connection between motor 20 and labeling machine 2, so that filling and closing machine can be driven independently of labeling machine 2. The claw clutch coupling 33 is arranged in such a way that it can only catch when the pockets of the conveyor stars 15 and 17 correspond with each other.

Should it be necessary to drive the labeling machine 2 independently from the filling and closing machine 1, an auxiliary motor 34 having low capacity with a drive 35 is mounted on housing 2*a*. Auxiliary motor 34 can drive the toothed wheel rim 29 through a pinion 36. A free wheeling coupling (not shown) is fitted between drive 35 and pinion 36, so that, in case of a synchronous drive of both machines by the main motor 20, the drive connection between auxiliary motor 34 and toothed wheel rim 29 can be opened. Also, the pinion 36 can be arranged to be movable on a spline shaft for disconnecting the drive.

The switch for the main motor 20 and the coupling 33 as well as other controls that are necessary for a synchronous drive of both machines are preferably mounted in the operating panel 6 of the filling and closing machine 1. The controls for the auxiliary motor 34 are mounted in an additional operating panel 37 on the labeling machine 2.

From FIG. 2 it can be seen that the housings 1*a* and 2*a* of both machines are directly connected in the area of the conveyor star wheel 15 and that gears 26, 27 are disposed partly in openings 38 in abutting walls of housing 1*a* and 2 *a*. It is not absolutely necessary that the pitch circles of the transport star wheels 13 to 15 and 17 conform with the pitch circles of gears 24 to 28, but it is also possible to use smaller gears whereby additional intermediate gears are necessary.

Figure 3:
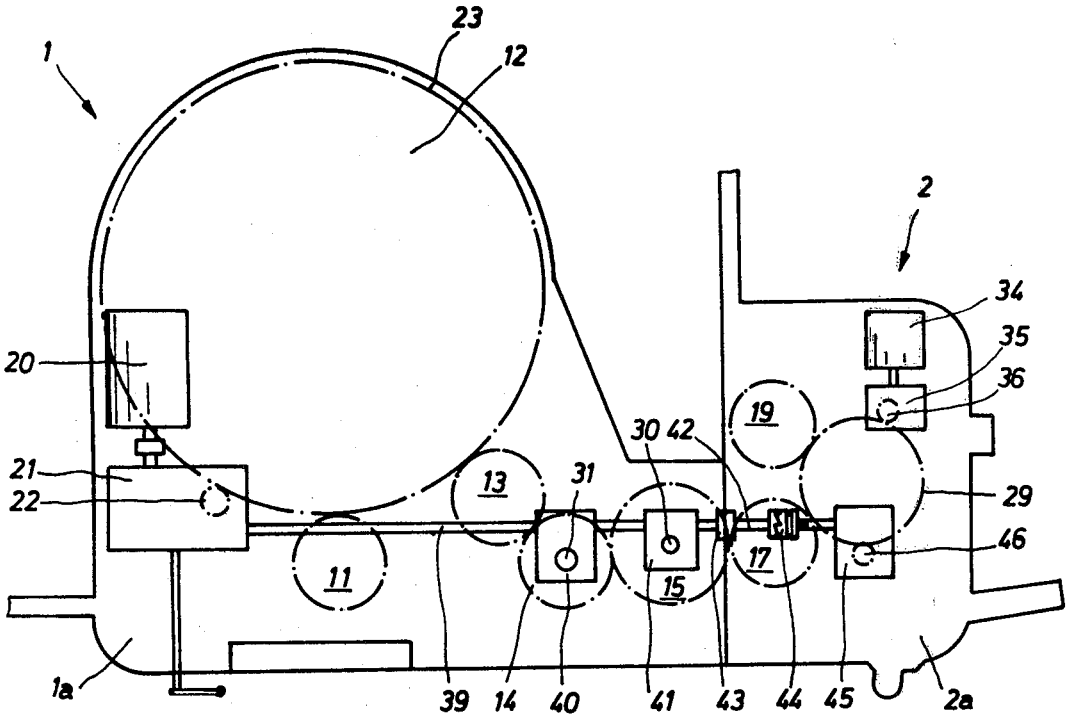
FIG. 3 is a schematic top view of a bottle treating unit shown in FIG. 1 with a modified drive apparatus.

The bottle treating apparatus shown in FIG. 3 conforms with the apparatus shown in FIG. 1, except for a part of the driving means. Transmission of the driving moment is not effected by gears which are connected with the conveyor star wheel in this case, but by a shaft 39 which is fitted in the housing 1*a* and is driven by the drive 21. A further drive 40 is connected with the shaft 39 which drives the hollow shaft 31 of the closing apparatus. The star wheels 11, 13 and 15 can be driven by the toothed wheel rim 23 of the bottle table 12, by a gear which is placed on the shaft 31, or by a separate worm gear 41 driven by the fast-running shaft 39 or the like.

In the housing 2*a* of the labeling machine, there is also placed a shaft 42 which aligns with the shaft 39 of the filling and closing machine. Both shafts 39 and 42 are connected with a coupling 43. The shaft 42 drives another drive transmission 45 by means of a regulatable claw clutch coupling 44. Transmission 45 powers the bottle table 18 of the labeling machine, the infeed star and outfeed star, and the labeling devices through a pinion 46 which is in mesh with the toothed wheel rim 29. The coupling 44 enable the drive for the two machines to be separated, whereafter the filling and closing machine 1 can be driven independently from main motor 20 and the labeling machine 2 can be driven from auxiliary motor 34.

Figure 4:
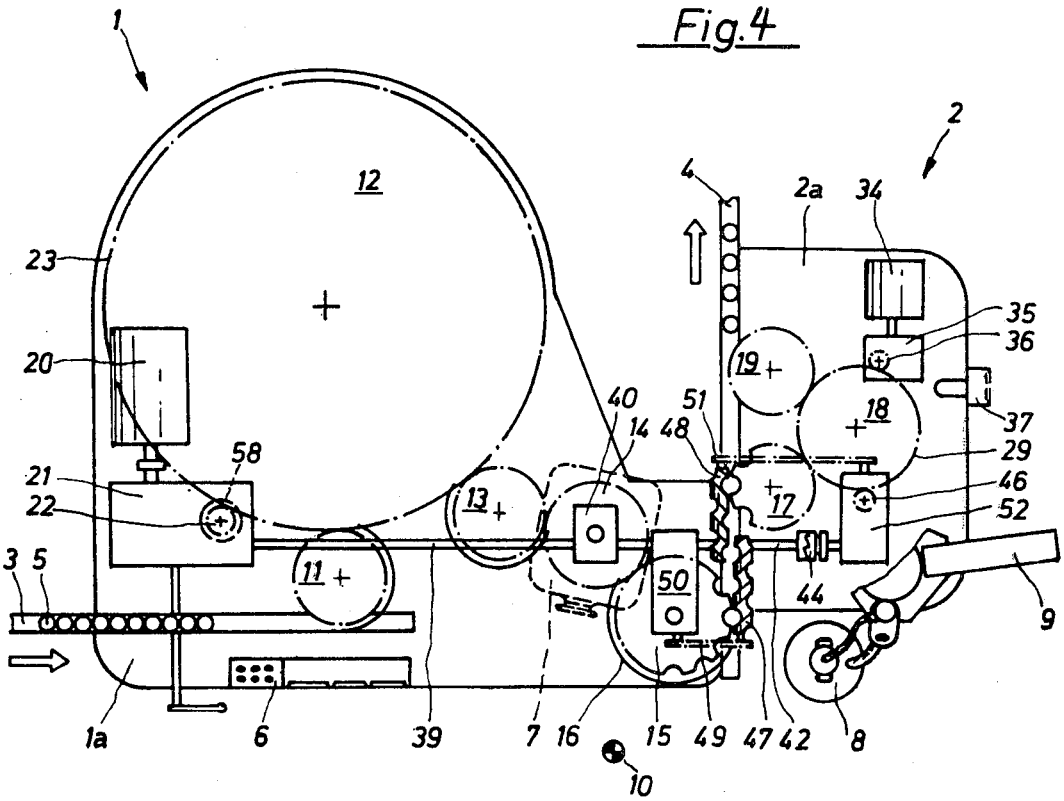
FIG. 4 is a schematic top view of a bottle treating unit according to FIG. 1 with a modified conveyor means between the closing machine and labeling machine.
Figure 5:
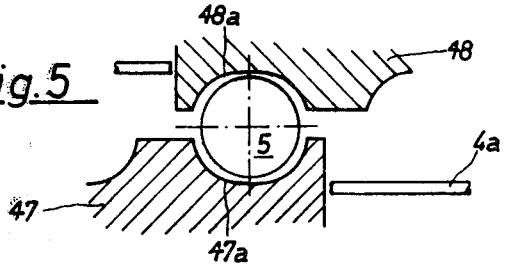
FIG. 5 is an enlarged horizontal section through both conveyor worms shown in FIG. 4 at the place where the two worms overlay.

The bottle treating unit shown in FIGS. 4 and 5 mainly corresponds with the unit shown in FIG. 3 except for the conveyor means. Between the conveyor star wheel 15, which takes the bottles from the closing unit 7, and the infeed star wheel 17 of the labeling machine 2, two worms 47, 48 are mounted. The two worms 47 and 48 are positioned on two different sides of the conveyor line of the bottles, the end of the first worm 47 being positioned opposite to the beginning of the second worm 48. The worms 47 and 48 are formed in such a way, that the bottles 5 can move from the first worm 47 to the second worm 48 without pausing. In this case the bottles are standing on the outfeed conveyor 4 or on another driven or stable surface and are led by railings 4*a* in the usual manner (FIG. 5).

As is visible in FIG. 5, the cross sections of the threads 47*a* and 48*a* of the two worms 47 and 48 are larger in the area opposite each other than it is necessary for receiving the bottle 5. That appears especially in case of expansion of the threads in longitudinal direction to the worms 47 and 48 so that the threads have an approximately oval cross section. Deviations from the exact position of the angle of the worms to each other, perhaps arising because of play in the drive, which cause a shifting of the threads, therefore cannot lead to any damage of the worms or bottles. The drive of the first worm 47 is effected by chain connection 49 or the like coupled to the drive 50, which at the same time drives the conveyor star wheel 15. The drive of the second worm 48 is effected by a chain connection 51 or the like coupled to the drive 52, which at the same time drives the labeling machine 2.

Figure 6:
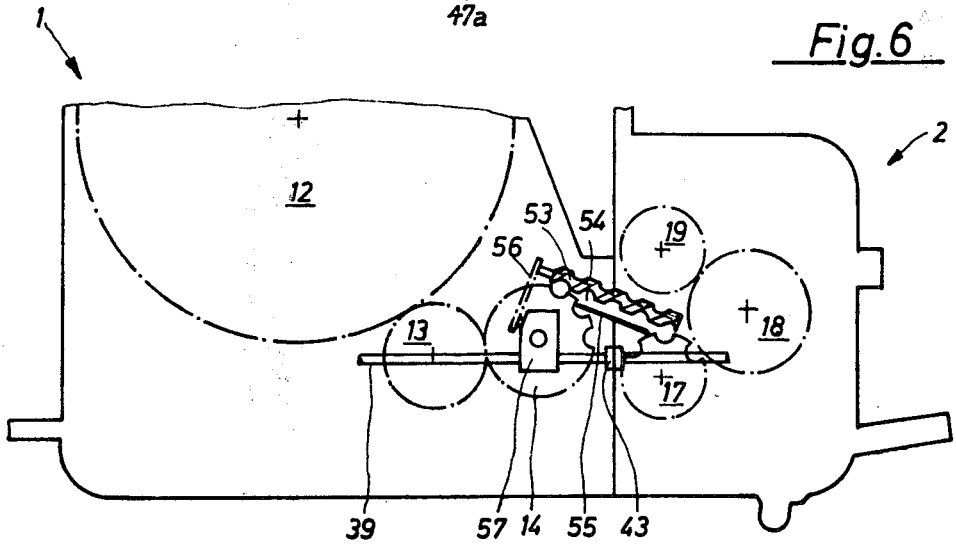
FIG. 6 is a fragmentary schematic top view of a bottle treating unit according to FIG. 1 with a modified conveyor means between the closing machine and labeling machine.

The bottle treating unit shown in FIG. 6 mainly differs from that shown in FIG. 4 by the fact that movement of the bottles between filling and closing machine 1 and labeling machine 2 is effected by means of a single worm 53. Worm 53 is arranged so that it immediately takes the bottles 5 from the conveyor star wheel or the table 14 of the closing machine and passes them to the infeed star wheel 17 of the labeling machine. The bottles are standing on a fixed support 54 and are led by a railing 55. The drive of the infeed worm 53 is effected by a chain connection 56 or the like coupled to a drive 57, which at the same time drives the conveyor star wheel 14 and the closing machine and is connected with the shaft 39 mounted on the frame of filling and closing machine 1.

If the bottle tables 12 and 18 of filling and closing machine 1 and labeling machine 2 have the same pitch, all conveyor star wheels and feed worms have this pitch, If, however, the pitch is greater in the labeling machine 2, at least one of the two worms 47 and 48 and the worm 53 desirably have a progressively increasing pitch, so that the bottles are brought to the desired spacing when reaching the infeed star wheel 17.

In the event it is not desired to separately drive and control the filling and closing machine 1 and labeling machine 2, the auxiliary motor 34 with drive 35 and pinion 36 can be eliminated and a positive coupling 58 can be fitted between drive 21 and pinion 22. Thus, the filling and closing machine 1 or the labeling machine 2 can be driven concurrently or separately by the motor 20 by means of regulating the couplings 44 and 48 (FIG. 4).

We Claim:

1. Bottle treating apparatus comprising a bottle filling and closing machine, a bottle labeling machine, bottle infeed conveyor means for conveying empty bottles into said bottle filling and closing machine, positive pitch conveyor means for conveying in mutually spaced relation filled and closed bottles from said bottle filling and closing machine to said bottle labeling machine, a bottle outfeed conveyor means for conveying filled, closed, and labeled bottles away from said labeling machine, said bottle infeed conveyor means, said positive pitch conveyor means and said bottle outfeed conveyor means together forming a conveyor path on which said bottles travel through the apparatus, said bottle filling and closing machine and bottle labeling machine being located on opposite sides of said conveyor path and being mounted close enough to each other that both machines can be operated by a single operator, drive means for said labeling machine and a releasable clutch in said drive means for said labeling machine to permit said filling and closing machine to be driven independently of said labeling machine.

2. The bottle treating apparatus of claim 1 and also including an auxiliary drive motor and drive means coupling the same to said labeling machine, the last mentioned drive means including a free wheeling clutch which permits said labeling machine to be driven by either motor.

* * * * *